US008820872B2

(12) United States Patent
Miwa

(10) Patent No.: US 8,820,872 B2
(45) Date of Patent: Sep. 2, 2014

(54) PRINTING APPARATUS AND METHOD HAVING DUAL PRINTING MODES

(75) Inventor: Shinji Miwa, Hokuto (JP)

(73) Assignee: Seiko Epson Corporation

( * ) Notice: Subject to any disclaimer, the term of this patent is extended or adjusted under 35 U.S.C. 154(b) by 116 days.

(21) Appl. No.: 13/413,573

(22) Filed: Mar. 6, 2012

(65) Prior Publication Data

US 2012/0229545 A1 Sep. 13, 2012

(30) Foreign Application Priority Data

Mar. 8, 2011 (JP) ..... 2011-050194

(51) Int. Cl.
*B41J 29/38* (2006.01)
*B41M 5/00* (2006.01)
*B41J 2/21* (2006.01)

(52) U.S. Cl.
CPC ..... *B41M 5/00* (2013.01); *B41J 2/2117* (2013.01)
USPC ..... 347/14

(58) Field of Classification Search
CPC ..... B41J 2/2117; B41M 5/00
USPC ..... 347/9, 12, 14
See application file for complete search history.

(56) References Cited

U.S. PATENT DOCUMENTS

| | | | | |
|---|---|---|---|---|
| 2003/0002064 | A1 | 1/2003 | Otsuki | |
| 2005/0237352 | A1 * | 10/2005 | Yoneyama | 347/9 |
| 2007/0188547 | A1 | 8/2007 | Kobayashi et al. | |
| 2009/0040550 | A1 | 2/2009 | Marumoto et al. | |
| 2011/0187775 | A1 * | 8/2011 | Masada et al. | 347/12 |
| 2011/0235069 | A1 | 9/2011 | Otsuka et al. | |

FOREIGN PATENT DOCUMENTS

| | | |
|---|---|---|
| JP | 2002-103582 | 4/2002 |
| JP | 2007-50555 | 3/2007 |
| JP | 2010-76102 | 4/2010 |
| JP | 2010-149516 | 7/2010 |
| WO | 2005-105452 | 11/2005 |

* cited by examiner

*Primary Examiner* — Laura Martin
*Assistant Examiner* — Carlos A Martinez
(74) *Attorney, Agent, or Firm* — Workman Nydegger

(57) ABSTRACT

A printing method includes selecting any one of a first printing mode and a second printing mode based on a printing position error data and an permissible printing position error; and performing a printing process based on the selected printing mode, wherein the first printing mode is a mode in which after a first liquid is discharged to the recording medium, the recording medium is transported to a upstream side in the transportation direction and other liquid is discharged, and the second printing mode is a mode in which the first liquid is discharged from the upstream nozzles in the transportation direction to the recording medium and other liquid is discharged from nozzles that are positioned from downstream side in transportation direction.

6 Claims, 5 Drawing Sheets

PRINTING POSITION ERROR TABLE

| KINDS OF RECORDING MEDIA | IMAGE QUALITY | PRINTING POSITION ERROR D1 |
|---|---|---|
| GLOSSY PAPER | HIGH IMAGE QUALITY | 4 mm |
| | USUAL | 6 mm |
| | HIGH SPEED | 8 mm |
| MAT PAPER | HIGH IMAGE QUALITY | 2 mm |
| | USUAL | 3 mm |
| | HIGH SPEED | 5 mm |
| FILM | HIGH IMAGE QUALITY | 4 mm |
| | USUAL | 7 mm |
| | HIGH SPEED | 10 mm |

PRINTING APPARATUS AND METHOD HAVING DUAL PRINTING MODES

BACKGROUND

1. Technical Field

The present invention relates to a printing method and a printing apparatus.

2. Related Art

An ink jet type printing apparatus that is usually used to print using white (W) ink besides black (K), cyan (C), magenta (M) and yellow (Y) inks in other words, each color ink of black, blue, red and yellow is known. In the printing apparatus, for example, in a case where a recording medium is a transparent film, it is considered that white ink is discharged at the recording medium and an undercoat layer is formed, and then an image printing layer is printed by discharging the color on the undercoat layer.

In a case where the undercoat layer and the image printing layer are overlapped and printed in this manner, there are two methods described below. As a first method, initially an undercoat layer is printed and then positions of a discharging head and a recording medium return to their original positions, and the image printing layer is printed again on the undercoat layer from the original position (for example, see JP-A-2010-149516). In addition, as a second method, an undercoat layer is printed using a upstream side nozzle group in a direction of transporting the medium and an image printing layer is printed using a downstream side nozzle group in a direction thereof so that nozzle lines of a discharging head perform printing in a collectively overlapping manner (see JP-A-2010-76102).

However, in the above described related arts, there are problems as below. In the method disclosed in JP-A-2010-149516, although inks of the undercoat layer and the image printing layer are not cloudy, since the undercoat layer and the image printing layer are printed in two batches, there is concern that misalignment may occur at a printing position in the printing of a first layer and a second layer. In addition, in the method described in JP-A-2010-76102, although misalignment of the position between the undercoat layer and the image printing layer may be prevented, since printing speed decreases or ink that configures the image printing layer is discharged before ink that configures the undercoat layer dries, there is concern that the inks may be cloudy.

Meanwhile, since the recording medium where the printing process is performed may be used for various usages by user, required print qualities are different. In other words, according to the intended usage of the users, it is preferable to select a case of the printing method of JP-A-2010-149516 or a case of the printing method of JP-A-2010-76102. However, in the related art, since the selection of the printing modes depends on the decision of the user, it is difficult to say that the optimum printing mode is selected.

SUMMARY

An advantage of some aspects of the invention is that it provides a printing method and a printing apparatus where an optimum printing mode is selected so that printing process may be performed according to the intended usage of the users.

According to an aspect of the invention, there is provided a printing method that performs a printing process based on a first printing mode or a second printing mode in which a discharging head having a plurality of nozzles that discharges liquid to a recording medium reciprocates in a main-scanning direction, and liquid droplets are discharged to the recording medium that is transported in a sub-scanning direction orthogonal to the main-scanning direction from the nozzles of the discharging head, including: selecting any one of the first printing mode and the second printing mode based on a printing position error data that is obtained from a printing position error data table that is set in advance before the printing process is performed and is generated at the recording medium in a case where the printing process is performed by the first printing mode; and a permissible printing position error that is set based on predetermined input information; and performing the printing process with respect to the recording medium based on the printing mode that is selected by the selecting of the printing mode, wherein the first printing mode is a mode in which after a first liquid is discharged to the recording medium from the discharging head, the recording medium is transported to the upstream side in the transportation direction, and other liquid is discharged from the discharging head to the area of the recording medium onto which the first liquid has been discharged, and wherein the second printing mode is a mode in which the first liquid is discharged from the upstream nozzles of the nozzles in the transportation direction to the recording medium and other liquid is discharged from the nozzles that are positioned further downstream in transportation direction than the upstream nozzles in the transportation direction to the area of the recording medium onto which the first liquid has been discharged.

In the first printing mode, the first liquid and the other liquid are discharged to be overlapped at an interval so that the first liquid and the other liquid that is discharged on the first liquid are prevented from being cloudy and it is possible to obtain the printing image without muddiness and bleeding. However, since the recording medium reciprocates along the sub-scanning direction, an error may occur in the printing position of the first liquid and the other liquid. Meanwhile, in the second printing mode, the other liquid may be discharged to be overlapped on the first liquid with respect to the recording medium that moves along the sub-scanning direction (one direction) so that misalignment of a landing position of the liquid droplets may be prevented and the printing having a small printing error may be performed.

According to the invention, the user may select the optimum printing mode of the first printing mode and the second printing mode, for example, from the printing position error data that is set in advance and the permissible printing position error based on predetermined information that is input by the user. Thus, the user may obtain the recording medium onto which the optimum image is recorded according to the intended usage.

It is preferable that a plurality of the discharging heads be included and the discharging heads discharge the first liquid and the other liquid each having different usage on the recording medium respectively.

According to the aspect of the invention, as the first liquid and the other liquid each having different usage, ink for forming the undercoat printing layer at one side and ink for the image printing layer at the other side may be employed. Thus, for example, even on the recording medium such as a transparent film, the image printing layer is overlapped on the undercoat printing layer so that desired image may be printed without restriction of the recording medium.

It is preferable that one of the first liquid and the other liquid form the undercoat printing layer and the other thereof form the image printing layer in which a predetermined image is recorded in the printing process.

According to the aspect of the invention, for example, in a case where a film member that is a member having translucency is used as the recording medium, the order of laminating the undercoat printing layer and the image printing layer is changed so that even in a case where the image printing layer is seen from any one of the front surface side or the rear surface side of the film, the image printing layer may be visible.

It is preferable that, in the selecting of the printing mode, sizes of the printing position error data and the permissible printing position error be compared to each other, the first printing mode be selected in a case where the printing position error data is small, and the second printing mode be selected in a case where the printing position error data is large.

According to the aspect of the invention, the first printing mode or the second printing mode may be appropriately selected according to the size of the permissible printing position error.

It is preferable that the printing position error data table that is used in the selecting of the printing mode set, as a parameter, at least one of a printing length of the recording medium at which the printing process is performed, kinds of recording media and an image quality during printing.

If the printing position error data table is used, the printing position error data having high reliability may be obtained and the selection of the printing mode may be performed with high precision by using the printing position error data.

According to another aspect of the invention, there is provided a printing apparatus that performs a printing process based on a first printing mode or a second printing mode in which a discharging head having a plurality of nozzles that discharges liquid to a recording medium reciprocates in a main-scanning direction, and liquid droplets are discharged to the recording medium that is transported in a sub-scanning direction orthogonal to the main-scanning direction from the nozzles of the discharging head, including: a controller that performs printing mode selecting in which any one of the first printing mode and the second printing mode based on a printing position error data that is obtained from a printing position error data table that is set in advance before the printing process is performed and is generated at the recording medium in a case where the printing process is performed by the first printing mode, and a permissible printing position error that is set based on predetermined input information, and controls the discharging head so as to perform the printing process with respect to the recording medium based on the selected printing mode; wherein the first printing mode is a mode in which after a first liquid is discharged to the recording medium from the discharging head, the recording medium is transported to the upstream side in the transportation direction and other liquid is discharged from the discharging head to the area of the recording medium where the first liquid has been discharged, and wherein the second printing mode is a mode in which the first liquid is discharged from the upstream nozzles of the nozzles in the transportation direction to the recording medium and other liquid is discharged from the nozzles that are positioned further downstream in transportation direction than the upstream nozzles in the transportation direction to the area of the recording medium where the first liquid has been discharged.

According to the printing apparatus of the aspect of the invention, the optimum printing mode of the first printing mode and the second printing mode may be selected by the user according to the above described controller so that the optimum printing image may be printed on the recording medium according to the intended usage of the users.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
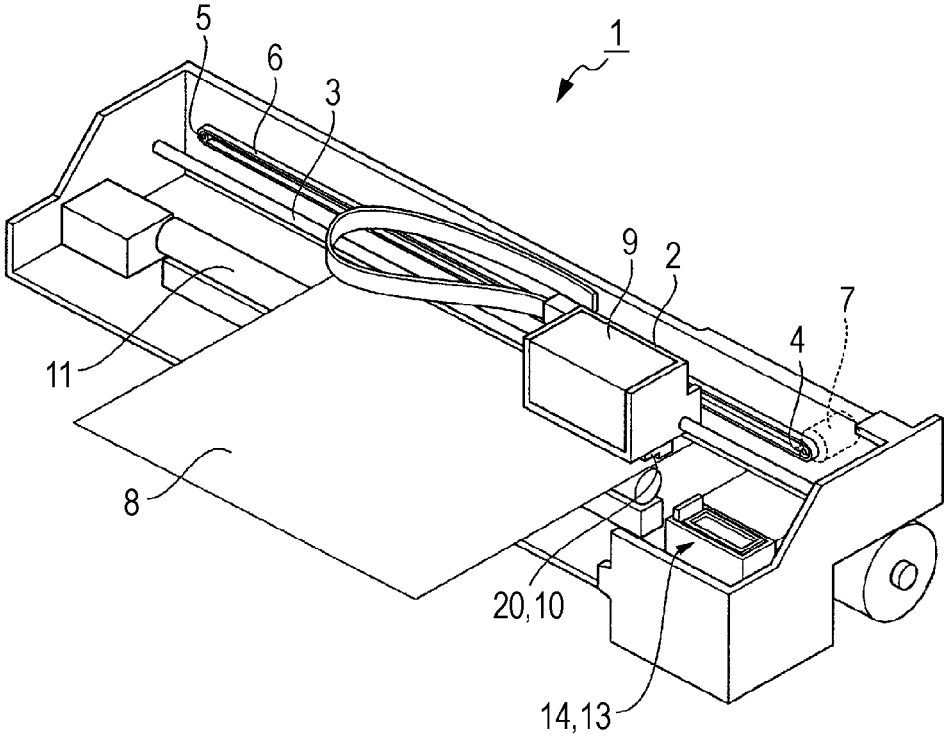
FIG. 1 is a view illustrating a schematic configuration of a printer.

Hereinafter, as an embodiment of a printing apparatus of the invention, a serial ink jet type printer (hereinafter, also referred to as "printer") is described as an example. In addition, as an embodiment of a printing method of the invention, a printing method according to the printer is described as an example. FIG. 1 is a view illustrating a schematic configuration of the printer according to the embodiment.

A printer (a liquid ejecting device) 1 has a carriage 2 that is movably attached to a guide shaft 3. The carriage 2 is connected to a timing belt 6 that is laid across between a driving pulley 4 and an idling pulley 5. Thus, the driving pulley 4 is joined to the rotation shaft of a driving motor 7. Thus, the carriage 2 moves in the width direction (main-scanning direction) of a recording medium 8 that is driven by the driving motor 7.

At lower side of the guide shaft 3, a paper transportation roller 11 is arranged in parallel with the guide shaft 3. The paper transportation roller 11 is rotated by driving force from a paper transportation motor (see FIG. 3) when the recording medium 8 is transported. Accordingly, the recording medium 8 performs printing process while the recording medium 8 is transported in a longitudinal direction (a sub-scanning direction).

A cartridge holder section is arranged at the carriage 2 and an ink cartridge unit 9 is detachably attached to the cartridge holder section. The ink cartridge unit 9 is a member that accumulates ink liquid, in other words, ink in liquid form.

Specifically, in the embodiment, the ink cartridge unit 9, for example, includes cartridges containing color ink of each color of for example, yellow (Y), magenta (M), cyan (C), black (K) and white (W).

Thus, when the ink cartridge unit 9 is mounted on the cartridge holder section, ink supply needles (not shown) that are arranged at the cartridge holder section are inserted into the ink cartridge unit 9. The ink supply needles are communicated with an ink supply tube (not shown) of each recording head (a discharging head) 10 of a head section 20 that is arranged at lower surface side of the carriage 2 respectively. Thus, the ink supply needle is inserted so that ink liquid in the ink cartridge unit 9 is supplied to the recording head 10 and ink from nozzles of each recording head 10 may be discharged.

In a moving range of the carriage 2, a home position is set to the outside of recording area and the recording head 10 is positioned at the home position when the printing operation is on standby or the like. A maintenance device 13 that performs a maintenance process with respect to the recording head 10 is arranged at the home position. The maintenance device 13 is configured of a capping mechanism 14 that may seal a nozzle surface of the recording head 10 in a non-recording state.

Figure 2:
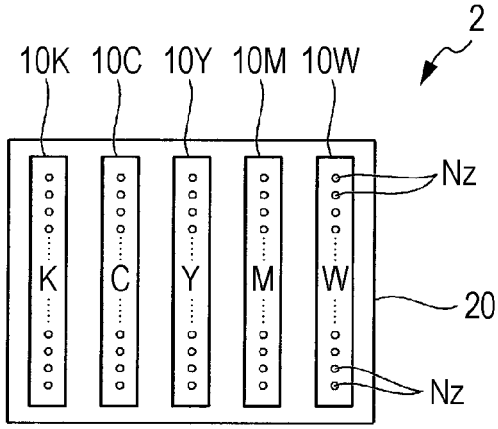
FIG. 2 is a configuration view of a head section.

FIG. 2 is a configuration view of the head section 20 where the printer 1 is seen from above. As shown in FIG. 2, the head section 20 that is arranged at the carriage 2 has recording heads 10Y, 10M, 10C, 10K and 10W that discharge each color ink that is supplied from the ink cartridge unit 9. In the drawing, reference numeral 10Y is a recording head that discharges yellow (Y) ink, 10M is a recording head that discharges magenta (M) ink, 10C is a recording head that discharges cyan (C) ink, 10K is a recording head that discharges black (K) ink and 10W is a recording head that discharges white (W) ink.

The recording heads 10 (10Y, 10M, 10C, 10K and 10W) have a plurality of nozzles Nz to discharge each ink and the nozzles Nz are arranged along the transportation direction (a sub-scanning direction) of the recording medium 8.

Figure 3:
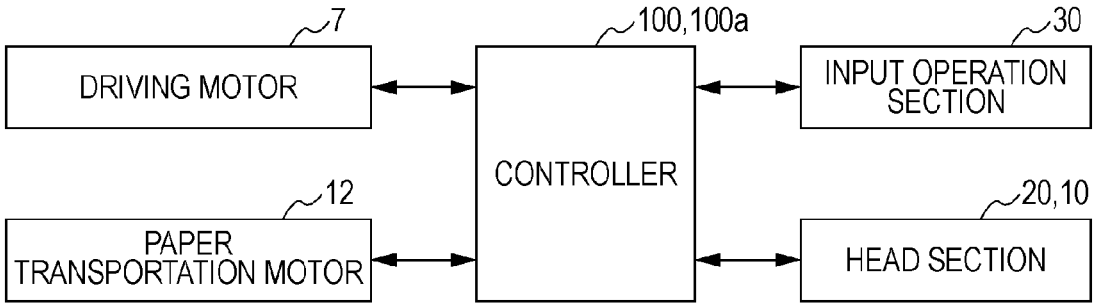
FIG. 3 is a block diagram illustrating an electrical configuration of the printer.

FIG. 3 is a block diagram illustrating an electrical configuration of the printer 1. As shown in FIG. 3, the printer 1 has a controller 100. The controller 100 is configured of, for example, a CPU, a RAM and a ROM ((not shown), and processing program that is stored in the ROM is expanded into the RAM and the processing program is performed by the CPU. The controller 100 controls operation of each member in conformity with the processing program, based on status of operation situation or the like of the driving motor 7, the paper transportation motor 12, the head section 20 or the like.

In addition, an upper surface of the case of the printer 1, for example, is configured by touch panel and an input operation section 30 where a user inputs predetermined information is provided. The input operation section 30 is connected to the controller 100 and configures a user interface section that outputs information that is input by the user to the controller 100.

Here, as the recording medium 8 that is used in the embodiment, materials of various kinds of papers such as a common paper, a recycled paper, a glossy paper or the like, various kinds of fabric, various kinds of nonwoven cloth, resin, metal, glass or the like are used, however for example, transparent resin film is appropriately used in the embodiment.

Meanwhile, the recording medium 8 is configured of above described transparent film so that in a case where a printing object (the recording medium 8 after printing) is visible from the printed surface, after white ink is discharged and an undercoat printing layer is printed, another color of ink is discharged and then an image printing layer that is configured of a desired color image is required to be printed (surface printing). Meanwhile, in a case where printing object is visible from a surface opposed to the printed surface, after the image printing layer is printed, the undercoat printing layer is required to be printed (rear printing). In addition, in below, in order to make the explanation clear, a case where above described surface printing is performed in the printing process with respect to the recording medium 8 is described as an example.

In other words, in the embodiment, the undercoat printing layer and the image printing layer are overlapped on the recording medium 8 so that the printing process is performed. However, in a case where different kinds of printing layers are overlapped, if white ink that configures the undercoat printing layer and color ink that configures the image printing layer are successively discharged and then the printing process is performed, white ink and color ink are mixed so that color bleeding occurs at the image printing layer and then image quality may be decreased.

The printer 1 according to the embodiment performs the printing process based on a multiple-printing mode (a first printing mode) M1 when the image quality is prevented from decreasing. Here, the multiple-printing mode M1 is a mode where after liquid droplets of white ink (a first liquid) is discharged to the recording medium 8 from the nozzles NZ of the recording head 10W, positional relation between the carriage 2 and the recording medium 8 returns to a state of timing when discharging of white ink starts with respect to the recording medium 8 and liquid droplets of color ink (a second liquid) from the recording heads 10Y, 10M, 10C and 10K besides the recording head 10W are discharged on the recording medium 8.

Figure 4A:
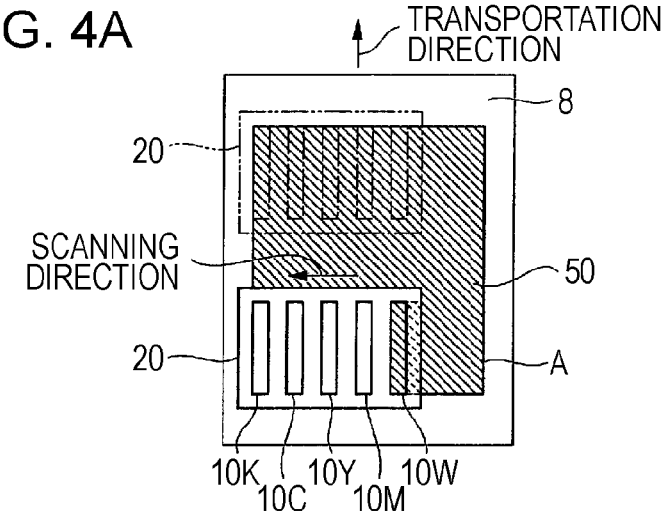
FIGS. 4A to 4C are explanatory views of printing process operations according to a multiple-printing mode.
Figure 4B:
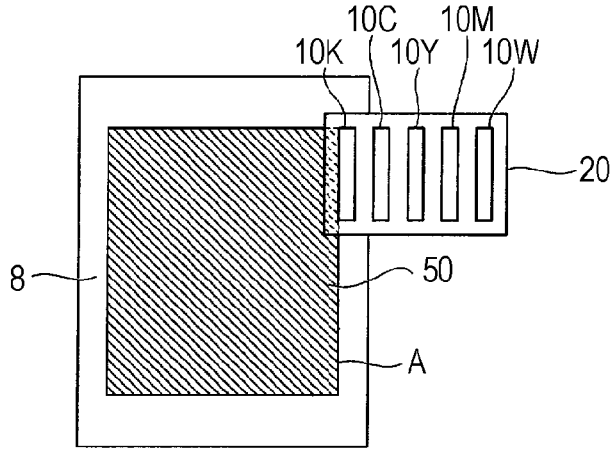
Figure 4C:
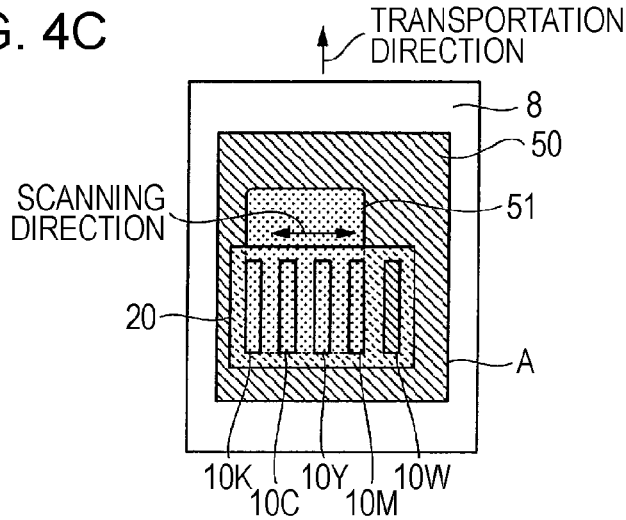

FIGS. 4A to 4C are concept views describing movement of the head section 20 and the recording medium 8 when the printing process is performed by the multiple-printing mode M1. As shown in FIG. 4A, in the multiple-printing mode M1, the printer 1 moves the carriage 2 that mounts the head section 20 in the scanning direction and transports the recording medium 8 in the sub-scanning direction so that white ink is discharged from the recording head 10W to the entire area of a printing area A in the recording medium 8 and then a undercoat printing layer 50 is formed. In addition, the controller 100 stores each of positional coordinates of the head section 20 and the recording medium 8 as an original point when the multiple-printing mode M1 starts.

Subsequently, as shown in FIG. 4B, the controller 100 drives the driving motor 7 and the paper transportation motor 12 so that the carriage 2 and the recording medium 8 return to the original point. Subsequently, as shown in FIG. 4C, the controller 100 discharges each ink from the nozzles NZ of the recording heads 10Y, 10M, 10C and 10K of the head section 20 to an area where the undercoat printing layer 50 is formed in the recording medium 8 and then an image printing layer 51 that is configured of a predetermined color image is formed.

As described above, in the multiple-printing mode M1, since a timing where the undercoat printing layer 50 is formed in the recording medium 8 and a timing where the image printing layer 51 is formed on the undercoat printing layer 50 are different, color ink is discharged on the undercoat printing layer 50 in a state where white ink that configures the undercoat printing layer 50 is dried. Accordingly, occurrence of color bleeding at the image printing layer due to the mixing of white ink and color ink is prevented and good image quality may be obtained.

However, since the multiple-printing mode M1 performs the printing the undercoat printing layer and the image printing layer in two batches, influence of a moving error of the carriage 2 or transportation error when the recording medium 8 is backwardly transported to the upstream side in the transportation direction is received and positional error (printing position error) of the image printing layer that is printed on the undercoat printing layer may occur.

In response, the printer 1 according to the embodiment performs the printing process based on a collective-printing mode (a second printing mode) M2 so that the above described printing position error may be prevented. Here, the collective-printing mode M2 is a mode where white ink is discharged to the recording medium 8 from the nozzles Nz of upstream side of the recording medium 8 in the transportation direction in the recording head 10W and color ink is discharged from the nozzles NZ in downstream side in the transportation direction in the recording heads 10Y, 10M, 10C and 10K besides the recording head 10W.

Figure 5A:
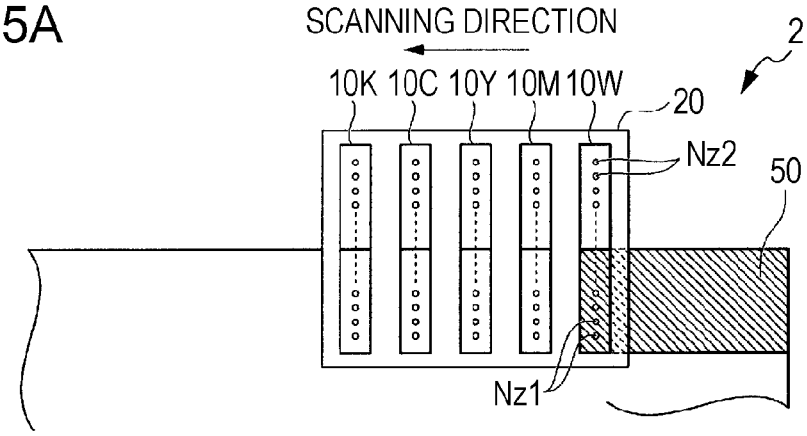
FIGS. 5A to 5C are explanatory views of a printing process operation according to a collective-printing mode.
Figure 5B:
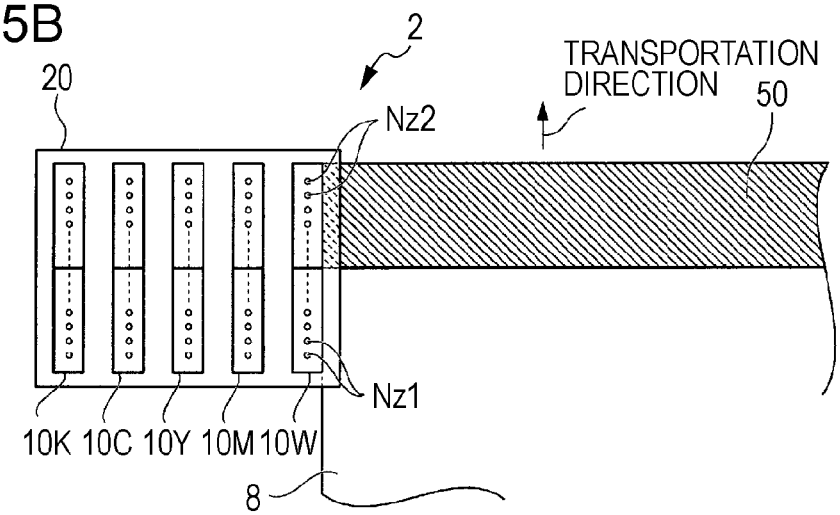
Figure 5C:
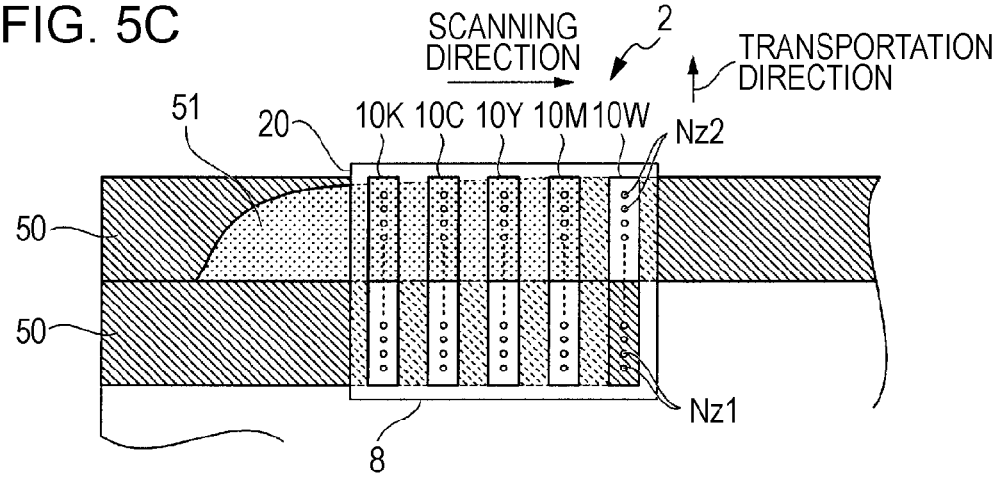

FIGS. 5A to 5C are concept views describing movement of the head section 20 and the recording medium 8 when the printing process is performed by the collective-printing mode M2. As shown in FIG. 5A, at the collective-printing mode M2, the printer 1 uses a range of nozzle lines used in each recording head 10 dividing in two as a first half area Nz1 (upstream side of the recording medium 8 in the transportation direction) and a second half area Nz2 (downstream side of the recording medium 8 in the transportation direction) from the center of the nozzle lines. Specifically, when initial scanning is performed, white ink is discharged from the nozzles Nz (hereinafter, may be referred to as the nozzles Nz1) of the first half area Nz1 of the recording head 10W so that the undercoat printing layer 50 is formed on the recording medium 8.

Subsequently, as shown in FIG. 5B, the controller 100 transports the recording medium 8 as much as a width of the undercoat printing layer 50. Accordingly, the second half area Nz2 and the undercoat printing layer 50 becomes a state of opposed to each other in the recording head 10.

Subsequently, as shown in FIG. 5C, the controller 100 discharges white ink on the recording medium 8 from the nozzles Nz1 of the recording head 10W and discharges color inks respectively to the undercoat printing layer 50 that is formed on the recording medium 8 from the nozzles NZ (hereinafter, may be referred to as the nozzles Nz2) of the second half area Nz2 in the recording heads 10Y, 10M, 10C and 10K besides the recording head 10W. Accordingly, the image printing layer 51 may be formed on the undercoat printing layer 50.

A step in which the image printing layer 51 is formed on the recording medium 8 is repeated wherein the recording medium 8 is transported as much as a distance of one divided area (the first half area Nz1 and the second half area Nz2) of the recording head 10 in each scan operation of the carriage 2, white ink is discharged on the recording medium 8 from the nozzles Nz1 of the recording head 10W so that the undercoat printing layer 50 is formed, color ink is discharged from the nozzles Nz2 in the recording heads 10Y, 10M, 10C and 10K on the undercoat printing layer 50 that is previously formed on the recording medium 8 so that surface printing process where the undercoat printing layer 50 and the image printing layer 51 are overlapped on the recording medium 8 may be performed.

As described above, in the collective-printing mode M2, white ink that configures the undercoat printing layer 50 and color ink that configures the image printing layer 51 may be overlapped and discharged with respect to the recording medium 8 that moves along the sub-scanning direction (one direction) so that occurrence of error in the position of the undercoat printing layer 50 and the image printing layer 51 may be prevented and the printing image where the printing position error is small may be obtained. In addition, in the above described collective-printing mode M2, since only a portion of nozzles Nz of the recording head 10 is used when the printing process is performed, the printing speed decreases compared to the above described multiple-printing mode M1.

Meanwhile, the recording medium 8 where the printing process is performed is variously used by the user, for example, in a case of a poster or the like where the printing object is seen from relatively close location and in a case of an advertisement or the like as the printing object that is mounted on a rooftop of a structure such as a building, required levels of the print quality are different. In other words, according to the intended usage of the user, the case where the multiple-printing mode M1 is preferably selected or the case where the collective-printing mode M2 is preferably selected is present between the multiple-printing mode M1 and the collective-printing mode M2.

Figures 6, 7:
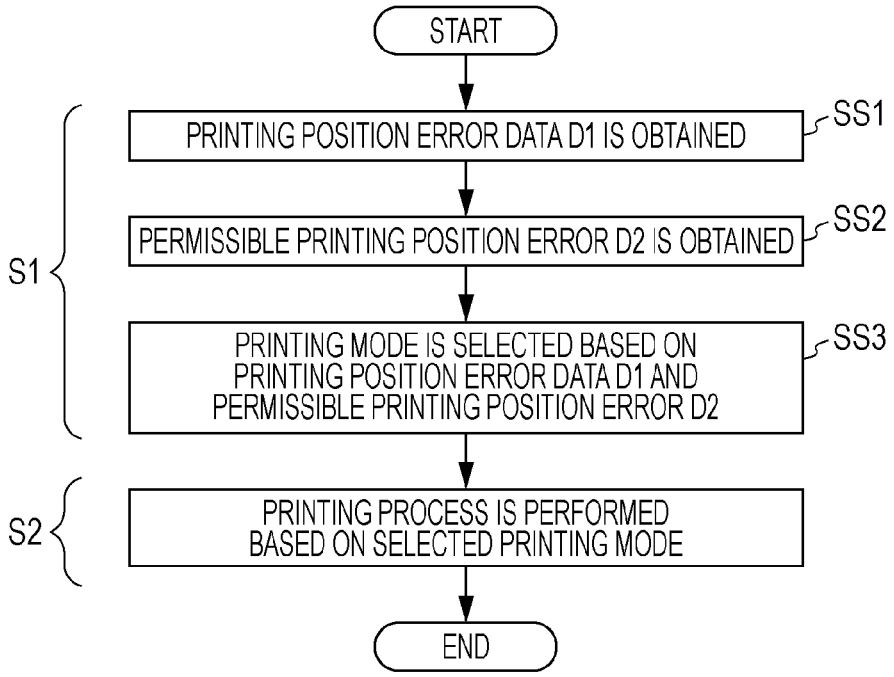
FIG. 6 is a flowchart of a printing operation of a printer.
FIG. 7 is a view illustrating an example of a printing position error data table.

In response, in the printer 1 according to the embodiment, before a mode selection section 100*a* of the controller 100 performs the printing process, a printing position error data D1 and an permissible printing position error D2 are compared and any one of the multiple-printing mode M1 and the collective-printing mode M2 is selected as an optimum mode (a printing mode selection step S1 in FIG. 6). In addition, the printing mode selection step S1 includes steps SS1 to SS3 described below.

In the printing mode selection step S1, the mode selection section 100*a* compares sizes of the printing position error data D1 and the permissible printing position error D2 and then the multiple-printing mode M1 is selected in a case where the printing position error data D1 is smaller than the permissible printing position error D2 and the collective-printing mode M2 is selected in a case where the printing position error data D1 is larger than the permissible printing position error D2.

The printing position error data D1 indicates error (a position misalignment amount) between the undercoat printing layer and the image printing layer that are generated at the recording medium 8 in a case where the printing process is performed based on the multiple-printing mode M1. The printing position error data D1 is output by performing test beforehand. The printing position error data D1 is derived from a printing position error data table that accommodates the printing position error values that are output by variously changing parameter values, wherein the parameter values are, for example, a printing length where the printing process is performed, material of the recording medium 8, image setting when printing is performed or the like.

At least printing data and print setting are input to the mode selection section 100*a*. The printing length when the data is printed may be known from the printing data. The print setting may be input accompanying the printing data and may be input by the user through the input operation section 30. In addition, as the print setting, any one of "high image quality", "standard" and "high speed" may be input as image quality setting and kinds of papers are inserted. The mode selection section 100*a* refers to the printing position error data table according to the print setting that is input, and obtains the printing position error data D1 (see step SS1 in FIG. 6).

Hereinafter, an example that obtains the printing position error data D1 from the printing position error data table will be described. FIG. 7 is a view illustrating an example of the printing position error data table. As shown in FIG. 7, in a case where the recording medium and the image quality setting are changed, the printing position error data table indicates values of the printing position error that is generated by performing the printing process based on the multiple-printing mode M1 and indicates that the error increases according to a decrease (high speed) of the image quality.

As shown in FIG. 7, for example, if the kind of the recording medium is "film" and the image quality setting is "usual", "7 mm" may be obtained as the printing position error data. Subsequently, the printing length is obtained from the printing data that is input. For example, the printing length is 2 m. Here, the value of the printing position error is proportional to the printing length. Accordingly, when the printing is performed at the multiple-printing mode M1, it is calculated that the printing position error of 7 (mm)×2 (m)=14 (mm) is generated. In addition, the printing position error data table may have, for example, a plurality of values of the printing position error according to certain printing lengths. In addition, the printing position error may be held as a function that calculates the printing position error with respect to the printing length without the value.

In addition, the permissible printing position error D2 is set based on a predetermined data that inputs when the user performs the printing process.

Here, the user directly inputs the permissible printing position error D2 from the input operation section 30. For example, the user inputs "10 mm" as the permissible printing position error. Thereupon, the mode selection section 100*a* compares the printing position error of "14 mm" of the printing position error data D1 that is output by the above described calculation and value of "10 mm" of the permissible printing position error D2 that is input. In this case, the printing position error data D1 exceeds the permissible printing position error D2. Accordingly, this case selects collective-printing mode M2 having multiple layers.

Meanwhile, when the user inputs "15 mm" as the permissible printing position error, the printing position error data D1 becomes the permissible printing position error D2 or less so that the mode selection section 100*a* selects the multiple-printing mode M1.

The permissible printing position error D2 may be set with respect to an observation distance that is input by the user. In this calculation, a visual angle and a visual acuity of the user when the user observes the recording medium 8 that is the printing object become reference.

The permissible printing position error D2 may be set by assuming that the printed material is seen at a certain distance (an observation distance). For example, the permissible printing position errors are different between a document or book that is seen when held in the hand and an outdoor signboard that is seen at a distance of tens of meters. Thus, the user inputs the observation distance to the input operation section 30 and calculates the permissible printing position error D2 from the observation distance. For example, the observation distance that is input is "5 m". At a distance of "5 m", a gap where the observer having the visual acuity of 1.0 may discriminate is calculated from 10 (m)×π÷360 (°)÷60 (')≅1.45 (mm) and it becomes about 1.45 mm. In addition, the visual acuity is an inverse number of the visual angle (minute) during the observation.

As described above, a limit on the distance of 5 m where the observer having the visual acuity of 1.0 is able to discriminate may be set to 1.45 mm as the permissible printing position error D2. In addition, the visual acuity of the observer that is assumed according to the intended usage may be changed, the actual visual acuity of the user is input from the input operation section 30 and the permissible printing position error D2 may be set based on the input value.

In addition, the permissible printing position error D2 may be set by analyzing the printing data. Here, the printing data is configured of data in which an image to be printed is converted to electronic data, for example, data of a page-description language such as PostScript or PDF, bit map image data such as TIFF or JPEG, or the like. In the calculation, for example, letter size, design element size, spatial frequency or the like are reference.

In the printing data including letter, the permissible printing position error D2 may be set as a ratio with respect to the minimum size of the letter. Additionally, the ratio may be changed according to the kinds of the letters. For example, 1% of the minimum size of the characters in Chinese characters and 2% of the minimum size of the letters in letters or numbers, and above described calculation is performed respectively in the printing data that includes both of the Chinese character and the letters or numbers are calculated respectively, so that the smaller may be set as the permissible printing position error D2. In addition, in the printing data including design elements such as figures, a ratio is set with respect to figure elements, for example the line thickness that configures the figure, and then may be regarded as the permissible printing position error D2.

As described above, the mode selection section 100*a* may obtain the permissible printing position error D2 (see step SS2 in FIG. 6).

As described above, the mode selection section 100*a* may select the optimum mode from any one of the multiple-printing mode M1 and the collective-printing mode M2 based on the printing data or the input information of the user according to the intended usage of the user (see step SS3 in FIG. 6).

Accordingly, the controller 100 controls such that ink is discharged to the recording medium 8 from the recording head 10 based on the selected printing mode and then the printing process is performed based on the above described each of modes M1 and M2 (see printing process step S2 in FIG. 6).

According to the above described embodiment, the optimum printing mode of the multiple-printing mode M1 or the collective-printing mode M2 may be selected by the user from the printing position error data D1 that is set in advance and the permissible printing position error D2 based on a predetermined information (including the printing data) that is input by the user. Accordingly, the user may obtain the recording medium 8 where the optimum image is recorded according to the intended usage.

In addition, the invention is not limited to the contents of the above described embodiment and modification may be appropriately performed without departing the gist of the invention.

For example, in the above described embodiment, the case where the surface printing is performed with respect to the recording medium 8 in the printing process is described as an example, however the invention may apply to a case of the rear printing where after the image printing layer 51 is printed on the recording medium 8, the undercoat printing layer 50 is printed.

In addition, the above described embodiment, a case is described where the undercoat printing layer is formed by white ink, however the undercoat printing layer may be configured such that metallic silver ink is discharged. In the above described embodiment, in the multiple-printing mode M1 and the collective-printing mode M2, a case where the undercoat printing layer is configured from white ink that is used as the first liquid and the image printing layer is configured from color ink that is used as the second liquid, however any one of the first liquid and the second liquid may be color ink (yellow, magenta, cyan and black). In other words, the invention may even be applied to a case where liquid having the same intended use are printed to be overlapped. Specifically, the invention may even be applied to a case where after black ink is printed as the undercoat, white ink and color ink are printed to be overlapped and then the printing layers are formed.

In addition, the invention may be applied to a case where after the first liquid and the second liquid are printed to be overlapped, a third liquid (for example, clear ink) is printed to be overlapped thereon so that the image printing layer is formed.

The entire disclosure of Japanese Patent Application No. 2011-050194, filed Mar. 8, 2011 is expressly incorporated by reference herein.

What is claimed is:

1. A printing apparatus comprising:

a discharging head that discharges liquid to a recording medium;

a controller that is capable of performing a printing by a first printing mode that discharges a first liquid to the recording medium from the discharging head, transports the recording medium to an upstream side in a transportation direction, and discharges other liquid to the recording medium from the discharging head, or a second printing mode that discharges the first liquid from a upstream nozzle of the discharging head, and discharges other liquid from a downstream nozzle that is positioned further downstream than the upstream nozzle in the transportation direction to the area of the recording medium onto which the first liquid has been discharged; and wherein, the controller selects the first printing mode or the second printing mode, based on a printing position error data that is generated when a printing is performed by the first printing mode, and a permissible printing position error that is set based on input information.

2. The printing apparatus according to claim 1, wherein the discharging head is a plurality of the discharging heads that discharge the first liquid and the other liquid each having different usage on the recording medium respectively.

3. The printing apparatus according to claim 1, wherein one of the first liquid and the other liquid forms an undercoat printing layer and the other thereof forms an image printing layer in which an image is recorded.

4. The printing apparatus according to claim 1, wherein, the controller selects the first printing mode when a size of an error of the printing position error data is smaller than a size of the permissible printing position error, and selects the second printing mode when the size of the error of the printing position error data is larger than the size of the permissible printing position error.

5. The printing apparatus according to claim 1, wherein the printing position error data is obtained from a printing position error data table based on at least one of a printing length of the recording medium at which the printing is performed, kinds of the recording medium, and an image quality.

6. A printing method comprising:

discharging liquid to a recording medium from a discharging head;

performing a printing by a first printing mode that discharges a first liquid to the recording medium from the discharging head, transports the recording medium to upstream side in a transportation direction, and discharges other liquid to the recording medium from the discharging head, or a second printing mode that discharges the first liquid from a upstream nozzle of the discharging head, and discharges other liquid from a downstream nozzle that is positioned further downstream than the upstream nozzle in the transportation direction to the area of the recording medium onto which the first liquid has been discharged; and wherein, selecting the first printing mode or the second printing mode, based on a printing position error data that is generated when a printing is performed by the first printing mode, and a permissible printing position error that is set based on input information.

* * * * *